US007320183B2

(12) United States Patent
Ishii et al.

(10) Patent No.: US 7,320,183 B2
(45) Date of Patent: Jan. 22, 2008

(54) METHOD FOR DRYING HONEYCOMB FORMED STRUCTURE

(75) Inventors: Takeyuki Ishii, Nagoya (JP); Yuji Asai, Chita (JP); Makoto Nakajo, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 161 days.

(21) Appl. No.: 10/570,266

(22) PCT Filed: Sep. 2, 2004

(86) PCT No.: PCT/JP2004/012738

§ 371 (c)(1),
(2), (4) Date: Mar. 2, 2006

(87) PCT Pub. No.: WO2005/024326

PCT Pub. Date: Mar. 17, 2005

(65) Prior Publication Data

US 2006/0283039 A1 Dec. 21, 2006

(30) Foreign Application Priority Data

Sep. 4, 2003 (JP) ..... 2003-312062

(51) Int. Cl.

| | |
|---|---|
| ***F26B 7/00*** | (2006.01) |
| ***F26B 3/34*** | (2006.01) |
| ***H05B 6/78*** | (2006.01) |
| ***H05B 6/64*** | (2006.01) |

(52) U.S. Cl. ..... 34/429; 34/428; 34/440; 34/250; 34/254; 34/259; 34/264; 264/414; 264/432; 264/489; 219/700

(58) Field of Classification Search ..... 24/428, 24/429, 440, 250, 254, 259, 264; 264/414, 264/432, 489; 219/700
See application file for complete search history.

(56) References Cited

U.S. PATENT DOCUMENTS 3,519,517 A * 7/1970 Dench ..... 219/759

(Continued)

FOREIGN PATENT DOCUMENTS

JP A 3-271150 12/1991

(Continued)

*Primary Examiner*—Jiping Lu
(74) *Attorney, Agent, or Firm*—Oliff & Berridge, PLC

(57) ABSTRACT

The invention provides a honeycomb formed structure drying method including causing undried honeycomb formed structures 10 placed on stands 12 to pass through a drying apparatus 1, thereby drying the undried honeycomb formed structures through high-frequency heating, to thereby form dried honeycomb formed structures 11; removing the dried honeycomb formed structures 11 from the stands 12; cooling the stands 12 which have been heated dried in the drying apparatus 1 are cooled to a temperature lower than the gelation temperature of the undried honeycomb formed structures 10; placing newly formed undried honeycomb formed structures 10 on the cooled stands 12; drying the undried honeycomb formed structures by passing through the drying apparatus 1; and repeating these operations. The honeycomb formed structure drying method prevents deformation such as warpage of partition walls of honeycomb formed structures during drying thereof.

9 Claims, 3 Drawing Sheets

U.S. PATENT DOCUMENTS

| | | | | |
|---|---|---|---|---|
| 3,731,036 | A * | 5/1973 | Hallier et al. | 219/695 |
| 4,057,702 | A * | 11/1977 | Lacombe-Allard | 219/701 |
| 4,439,929 | A * | 4/1984 | Kitagawa et al. | 34/254 |
| 4,837,943 | A * | 6/1989 | Mizutani | 34/250 |
| 5,265,346 | A | 11/1993 | Jikumaru et al. | |
| 6,768,089 | B2 * | 7/2004 | Minobe et al. | 219/699 |
| 6,932,932 | B2 * | 8/2005 | Miura et al. | 264/414 |
| 2002/0093123 | A1 | 7/2002 | Miura et al. | |
| 2002/0109269 | A1 | 8/2002 | Miura et al. | |

FOREIGN PATENT DOCUMENTS

| | | |
|---|---|---|
| JP | A 4-297783 | 10/1992 |
| JP | A 2002-283329 | 10/2002 |
| JP | A 2002-283330 | 10/2002 |

* cited by examiner

METHOD FOR DRYING HONEYCOMB FORMED STRUCTURE

TECHNICAL FIELD

The present invention relates to a method for drying a honeycomb formed structure and, more particularly, to a method for drying a honeycomb formed structure which method prevents partial drying of an undried honeycomb formed structure before complete drying of the honeycomb formed structure, thereby preventing deformation such as warpage of partition walls of the dried honeycomb formed structure.

BACKGROUND ART

Generally, ceramic-based honeycomb formed structures are produced through a procedure of, for example, forming (e.g., extruding) a raw material composition containing a predetermined ceramic source, a binder, and water to thereby form a formed structure of a honeycomb shape (a honeycomb formed structure) having a plurality of cells defined by partition walls, each cell serving as a fluid conduit; drying the honeycomb formed structure by means of hot air or an electromagnetic wave (high-frequency wave); and firing the dried honeycomb formed structure.

Ceramic honeycomb formed structures find uses such as cleaning of automobile exhaust gas and catalyst carriers. In recent years, cell partition walls of such honeycomb formed structures have come to be thinner, and partition walls and an outer wall of the aforementioned honeycomb formed structures are readily deformed or cracked during drying thereof. In order to prevent such deformation and cracking, drying is performed through high-frequency heating, which realizes drying of the entirety of the honeycomb formed structure more uniformly as compared with hot air drying. In the drying through high-frequency heating, an electromagnetic wave (high-frequency wave) having a frequency corresponding to water heating is applied to a honeycomb formed structure, thereby evaporating water by heating, whereby the honeycomb formed structure is dried. However, even when the high-frequency heating drying technique is employed, partial deformation of the dried honeycomb formed structure sometimes occurs in the production of the aforementioned ceramic honeycomb formed structure. For example, the problem occurs in the case in which, during drying of a honeycomb formed structure formed from a raw material composition, the formed honeycomb formed structure is placed on a stand; the honeycomb formed structure placed on the stand is transferred into a drying apparatus so as to dry the formed structure; the dried honeycomb formed structure is removed from the stand; and a newly formed undried honeycomb formed structure is placed on the stand so as to dry the undried honeycomb formed structure. In the above case, the stand is used repeatedly.

Meanwhile, in order to prevent deformation of partition walls and cracking of an outer wall, there has been proposed an approach in which high-frequency heating drying of a honeycomb formed structure is performed in a humidified atmosphere in a drying apparatus, thereby controlling the drying state of the honeycomb formed structure (see, for example, Patent Document 1). When this approach is employed, water may remain on a conveying tray on which a honeycomb formed structure is placed, since the atmosphere of the drying apparatus is highly humidified. Thus, there has been proposed a technique in which a conveying tray made of a predetermined porous ceramic material is employed so as to remove water. However, even when the technique is employed, if the conveying tray is used repeatedly, partial deformation and other defects of partition walls of the honeycomb formed structure are difficult to prevent.

[Patent Document 1]

Japanese Patent Application Laid-Open (kokai) No. 2002-283329

DISCLOSURE OF THE INVENTION

As mentioned above, partial deformation of partition walls of the dried honeycomb formed structure caused by repeated use of the stand occurs through the following mechanism. Specifically, the stand which has been employed for drying is heated during drying, and a new, undried honeycomb formed structure is placed on a high-temperature surface of the stand. Therefore, a portion of the undried honeycomb formed structure which is in contact with the high-temperature stand is locally heated and dried. Thus, when the undried honeycomb formed structure is locally dried, the dried portions of partition walls undergo partial shrinkage, resulting in deformation and other structural variation of the partition walls.

The present invention has been conceived in order to solve the aforementioned problem. Thus, an object of the present invention is to provide a method for drying honeycomb formed structure, which method can prevent partial drying of an undried honeycomb formed structure placed on a stand before drying of the honeycomb formed structure, and suppress deformation such as warpage of partition walls of the dried honeycomb formed structure.

In order to attain the aforementioned object, the present invention provides the following method for drying a honeycomb formed structure.

[1] A method for drying a honeycomb formed structure, the method comprising placing on a plurality of stands a plurality of honeycomb formed structures in an undried state (undried honeycomb formed structures) which have been formed through forming into a honeycomb structure a raw material composition containing a ceramic material, a binder, and water;

causing the undried honeycomb formed structures placed on the stands to pass through a drying apparatus equipped with a high-frequency heating means for providing a heated atmosphere from an entrance of the apparatus to an exit thereof;

drying the undried honeycomb formed structures through high-frequency heating, to thereby form dried honeycomb formed structures;

removing, from the stands, the dried honeycomb formed structures which have passed through the exit of the drying apparatus;

conveying the stands transferred through the exit of the drying apparatus to enter the entrance thereof in a circulating manner;

placing newly formed undried honeycomb formed structures on the stands which have been circulated and returned to enter the entrance of the drying apparatus; and repeating these operations, wherein the stands which have been heated in the drying apparatus are cooled to a temperature lower than the gelation temperature of the undried honeycomb formed structures until the stands are circulated and returned to enter the entrance of the drying apparatus; the newly formed undried honeycomb formed structures are placed on the cooled stands; and the undried honeycomb formed structures are caused to pass through the drying apparatus, thereby preventing partial deformation of dried honeycomb formed structure products, which deformation might be caused by localized heating, through heat from the stands, of portions of the undried honeycomb formed structures in contact with the stands and portions in the vicinity thereof (hereinafter these portions are referred to as the contact portions) upon placement of the undried honeycomb formed structures on the stands.

[2] A method for drying a honeycomb formed structure as described in [1], wherein, after removal from the stands of the dried honeycomb formed structures placed on the stands, the stands are cooled to a temperature lower than the gelation temperature of the undried honeycomb formed structures by application of cold air at 30° C. or lower.

[3] A method for drying a honeycomb formed structure as described in [1], wherein, after removal from the stands of the dried honeycomb formed structures placed thereon, the stands are cooled to a temperature lower than the gelation temperature of the undried honeycomb formed structures by spraying water at 30° C. or lower onto the stands, followed by applying cold air to the stands.

[4] A method for drying a honeycomb formed structure as described in any of [1] to [3], wherein, after drying of the undried honeycomb formed structures in the drying apparatus through high-frequency heating, to thereby form dried honeycomb formed structures, the dried honeycomb formed structures are further dried through application of hot air thereto in a hot air drying chamber disposed in the drying apparatus or outside the drying apparatus; the dried honeycomb formed structures are transferred from the hot air drying chamber; and subsequently, the dried honeycomb formed structures placed on the stands are removed therefrom.

[5] A method for drying a honeycomb formed structure as described in any of [1] to [4], wherein each of the stands has a plurality of through-holes running in a direction virtually normal to a face that defines an area which, when the honeycomb formed structure is placed on the stand, abuts the bottom surface of the honeycomb formed structure (hereinafter the face is referred to as the receiving face), and the through-holes are formed so as to have a percent opening with respect to the receiving face of 50% or more.

[6] A method for drying a honeycomb formed structure as described in any of [1] to [5], wherein the stands are made of at least one species selected from the components forming cordierite.

[7] A method for drying a honeycomb formed structure as described in [6], wherein the stands are made of alumina.

[8] A method for drying a honeycomb formed structure as described in any of [1] to [5], wherein the stands are made of an organic material having a softening temperature higher than 130° C.

[9] A method for drying a honeycomb formed structure as described in any of [1] to [8], wherein the electromagnetic wave employed in the high-frequency heating has a frequency of 10 to 10,000 MHz.

According to the honeycomb formed structure drying method of the present invention, the stands which have been dried in the drying apparatus are cooled to a temperature lower than the gelation temperature of the undried honeycomb formed structures until the stands are circulated and returned to enter the entrance of the drying apparatus, and the newly formed undried honeycomb formed structures are placed on the cooled stands. Therefore, the method of the invention can prevent drying, through heat from the stands, of portions of the newly formed undried honeycomb formed structures in contact with the stands and portions in the vicinity thereof (hereinafter these portions are referred to as the contact end portions) upon placement of the undried honeycomb formed structures on the stands, whereby shrinkage and deformation in the contact end portions of the undried honeycomb formed structures can be prevented.

DESCRIPTION OF THE REFERENCE NUMERALS

Figure 1:
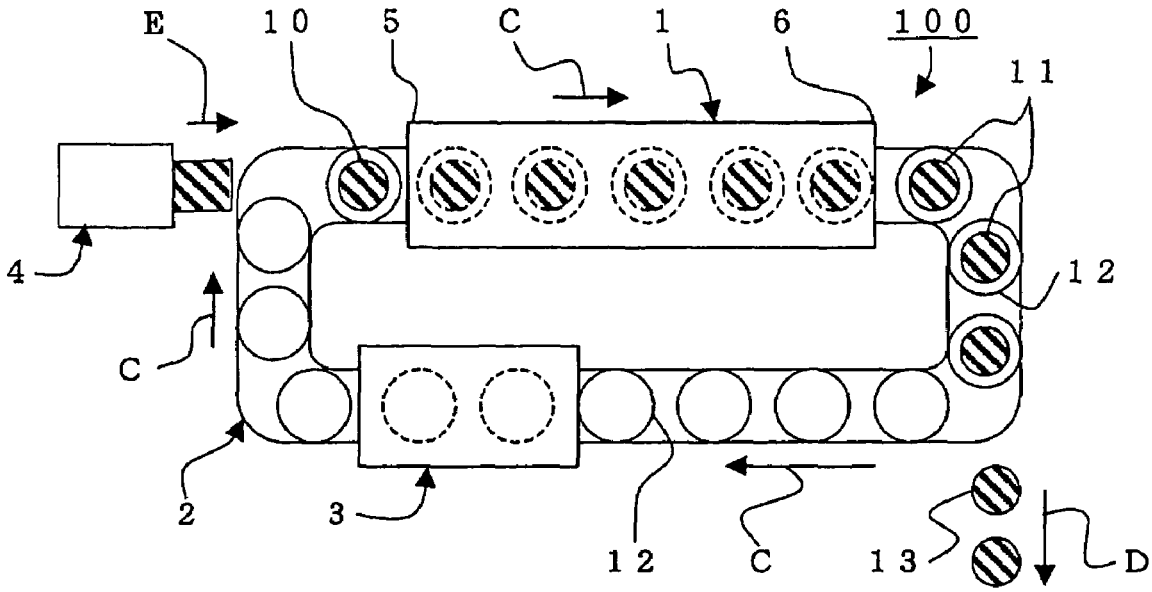
[FIG. 1] A plan view of a honeycomb formed structure drying system employed in an embodiment of the honeycomb formed structure drying method of the present invention.

1 . . . drying apparatus, 2,2*a* . . . conveyer, 3 . . . cooling apparatus, 4 . . . extruder, 5 . . . drying apparatus entrance, 6 . . . drying apparatus exit, 10 . . . undried honeycomb formed structure, 11 . . . dried honeycomb formed structure, 12 . . . stand, 12*a* . . . receiving member, 12*b* . . . support, 13 . . . honeycomb formed structure transferred to a subsequent step, 14 . . . honeycomb formed structure, 21 . . . drying chamber, 22 . . . electromagnetic wave generator, 24 . . . outer frame, 25 . . . roof, 26 . . . ceiling, 31 . . . hot air drying chamber, 32 . . . hot air generator, 33 . . . hot air discharge duct, 41 . . . cold air generator, 42 . . . discharge duct, 43 . . . outer frame of cooling apparatus, 100 . . . drying system, C . . . circulation direction, D . . . subsequent step direction, E . . . discharge direction, and F . . . honeycomb formed structure running direction.

BEST MODES FOR CARRYING OUT THE PRESENT INVENTION

Best modes for carrying out the present invention (hereinafter may be referred to as "embodiments") will next be described with reference to the drawings. However, these embodiments should not be construed as limiting the invention thereto. It is also understood by those skilled in the art that appropriate changes and modifications in arrangement of the embodiments may be made in the invention without departing from the scope of the present invention. In the drawings, the same reference numerals denote components common to the drawings.

FIG. 1 is a plan view of a honeycomb formed structure drying system employed in the embodiment of the honeycomb formed structure drying method of the present invention.

The embodiment of the honeycomb formed structure drying method of the present invention can be carried out by means of a honeycomb formed structure drying system 100 (hereinafter may be referred to simply as "drying system 100") shown in FIG. 1. However, the drying system to be employed in the embodiment is not limited to the drying system 100 shown in FIG. 1.

As shown in FIG. 1, in the embodiment of the honeycomb formed structure drying method, firstly, an honeycomb formed structure in the undried state (undried honeycomb formed structure) 10 is produced through forming of a raw material composition containing a ceramic raw material and water into a honeycomb shape by means of an extruder 4 (arrow E (discharge direction E): direction of discharging the undried honeycomb formed structure 10 through the extruder 4). The thus-formed undried honeycomb formed structure 10 is placed on a stand 12 for circulating the formed structure via a conveyer 2. The undried honeycomb formed structure 10 placed on the stand 12 is transferred by means of the conveyer 2. The conveyer 2, on which the stands 12 are placed, conveys the stands 12 so as to pass them through a cylinder-form drying apparatus 1 and a cylinder-form cooling apparatus 3 and forms a circulating system for circulating the formed structures in the circulation direction C denoted by an arrow. The undried honeycomb formed structures 10 placed on the stands 12 are caused to pass through the drying apparatus 1 equipped with a high-frequency heating means for providing a heated atmosphere from an entrance (drying apparatus entrance) 5 to an exit (drying apparatus exit) 6, whereby the undried honeycomb formed structures 10 are dried through high-frequency heating to thereby form dried honeycomb formed structures 11. Subsequently, the dried honeycomb formed structures 11 which have passed through the drying apparatus exit 6 are removed from the stands 12 and fed to a subsequent step as honeycomb formed structures 13 to be treated in a subsequent step. The arrow D (subsequent step direction D) shows the feature that the dried honeycomb formed structures 11 are fed to the subsequent step. The stands 12 which have been heated in the drying apparatus 1 are conveyed from the drying apparatus exit 6 to enter the drying apparatus entrance 5 in a circulating manner through moving along the circulating system provided by the conveyer 2. In this case, until the stands 12 are circulated and returned to enter the drying apparatus entrance 5, the stands 12 are cooled by means of passage through the cooling apparatus 3 to a temperature lower than the gelation temperature of the undried honeycomb formed structures 10. When the thus-cooled stands 12 have been circulated and returned to enter the drying apparatus entrance 5, newly formed undried honeycomb formed structures 10 are placed on the cooled stands 12. Through repetition of these operations, a plurality of undried honeycomb formed structures 10 are dried.

Thus, the stands 12 which have been dried in the drying apparatus 1 are cooled to a temperature lower than the gelation temperature of the undried honeycomb formed structures 10 until the stands 12 are circulated and returned to enter the drying apparatus entrance 5, and the newly formed undried honeycomb formed structures 10 are placed on the cooled stands 12. Therefore, there can be prevented drying, through localized heat from the stands 12, of portions of the newly formed undried honeycomb formed structures 10 in contact with the stands 12 and portions in the vicinity thereof (contact end portions) upon placement of the undried honeycomb formed structures 10 on the stands 12, whereby shrinkage and deformation in the contact end portions of the undried honeycomb formed structures can be prevented. The phenomenon "gelling an undried honeycomb formed structure" refers to hardening of the binder incorporated into the honeycomb formed structure. Undried honeycomb formed structures may be gelled at a temperature higher than 30° C.

When forming failure products of the undried honeycomb formed structures are formed, the undried honeycomb formed structure failure products are not dried in the drying apparatus. Instead, the honeycomb structures may be crushed, and the crushed material is fed to a raw material composition for producing undried honeycomb formed structures. Meanwhile, when an undried honeycomb formed structure is placed on a heated stand, the contact end portion of the formed structure is dried and deformed, and the contact end portion is partially gelled, to form a hard mass. Therefore, when an undried honeycomb formed structure having a contact end portion which has been partially converted to a hard mass is crushed and returned to a raw material composition as mentioned above, in some cases, the added undried honeycomb formed structure cannot be completely dispersed in the raw material composition due to aggregation of the hard mass. In this case, the raw material containing such aggregates are undesirably formed to form new products. Thus, when the raw material composition contains hard mass aggregates, during subsequent forming to form a new undried honeycomb formed structure, cells of the undried honeycomb formed structure may be plugged, or partition walls may be broken.

According to the embodiment of the honeycomb formed structure drying method, formation of a hard mass through localized heating of undried honeycomb formed structures placed on the stands is prevented. Therefore, when undried honeycomb formed structures are re-fed to a raw material composition without drying the structures, the raw material can be formed to form undried honeycomb formed structures again. In this case, the raw material composition contains no hard mass aggregations, and cell plugging and breakage of the re-formed undried honeycomb formed structures can be prevented.

In the honeycomb formed structure drying system 100 shown in FIG. 1 employed in the embodiment of the honeycomb formed structure drying method, no particular limitation is imposed on the type of the drying apparatus 1, and any drying apparatus may be employed, so long as the entirety of a honeycomb formed structure can be dried in a virtually uniform manner. For example, a hot air drying apparatus, a high-frequency heating drying apparatus, and a drying apparatus on the basis of hot air heating and high-frequency heating may be employed. Of these, a drying apparatus performing hot air heating and high-frequency heating in combination for effective drying is preferably employed.

Figure 2:
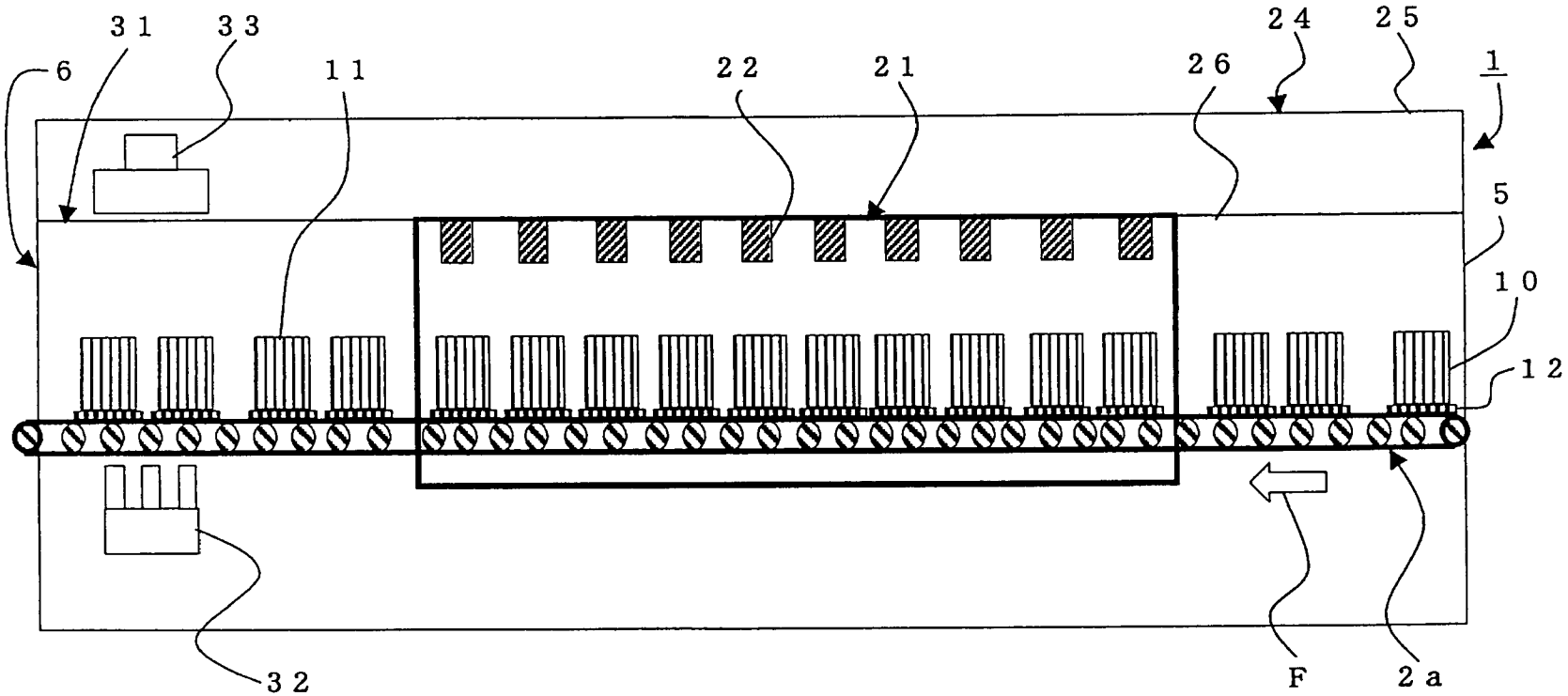
[FIG. 2] A schematic cross-sectional view of a honeycomb formed structure drying apparatus employed in an embodiment of the honeycomb formed structure drying method of the present invention.

For example, a drying apparatus 1 as shown in FIG. 2 may be employed as the drying apparatus 1 shown in FIG. 1. FIG. 2 is a schematic cross-sectional view of the honeycomb formed structure drying apparatus 1 employed in the embodiment of the honeycomb formed structure drying method of the present invention. As shown in FIG. 2, the drying apparatus 1 includes, in a cylindrical outer frame 24, a drying chamber 21 for accommodating undried honeycomb formed structures 10 in a humidified and heated atmosphere; an electromagnetic wave generator 22 for generating an electromagnetic wave with which the undried honeycomb formed structures 10 accommodated in the drying chamber 21 are to be irradiated; and a hot air drying chamber 31 for further drying, through hot air, the dried honeycomb formed structures 11, which have been produced by drying the undried honeycomb formed structures 10 through high-frequency heating. In addition, a conveyer 2*a* is disposed so as to pass through the drying apparatus 1 from the drying apparatus entrance 5 to the drying apparatus exit 6, such that honeycomb formed structures are placed into the drying apparatus 1 through the drying apparatus entrance 5 and discharged through the drying apparatus exit 6. The conveyer 2*a* constitutes a part of the circulation system formed by the conveyer 2 shown in FIG. 1.

The outer frame 24 forming the drying apparatus 1 is formed in a cylindrical shape such that the center axis is oriented virtually in the horizontal direction. Undried honeycomb formed structures 10 are transferred into the drying apparatus through the drying apparatus entrance 5, and the dried honeycomb formed structures 11 are removed through drying apparatus exit 6. In the outer frame 24, a ceiling 26 is disposed virtually in the horizontal direction so as to provide a space between the ceiling and a roof 25 of the outer frame 24, and divides the outer frame 24 into two chambers. The drying chamber 21 is formed into a cylinder, and the center axis of the cylinder virtually aligns the center axis of the outer frame 24. The drying chamber is disposed under (in the vertical direction) the roof 25 formed in the outer frame 24.

In the embodiment of the honeycomb formed structure drying method, when the undried honeycomb formed structures 10 are dried by means of the drying apparatus 1, the following procedure is employed. Firstly, as shown in FIG. 2, the undried honeycomb formed structures 10 are placed on the stands 12 which are transferred by means of the conveyer 2 which is circulating (see FIG. 1) and are transferred into the drying apparatus through the drying apparatus entrance 5. The undried honeycomb formed structures 10 are conveyed through driving force of the conveyer 2*a* so as to move in the honeycomb formed structure conveyance direction F, followed by transferring into the drying chamber 21 through one end of the drying chamber 21 by means of the conveyer 2*a*. While the undried honeycomb formed structures 10 are conveyed by means of the conveyer 2*a* in the drying chamber 21, the undried honeycomb formed structures 10 are subjected to high-frequency heating for drying through irradiation with an electromagnetic wave generated by the electromagnetic wave generator 22 in the drying chamber 21 of which atmosphere is controlled to a predetermined humidity and temperature, to thereby form the dried honeycomb formed structures 11. Subsequently, the thus-dried honeycomb formed structures 11 are removed from the drying chamber 21 through the other end thereof and transferred to a hot air drying chamber 31. The dried honeycomb formed structures 11 are conveyed by means of the conveyer 2*a* in the hot air drying chamber 31, while further dried through application of hot air to the formed structures 11. Subsequently, the formed structures 11 are removed from the hot air drying chamber 31 to the outside, and transferred to the outside of the drying apparatus 1 through the drying chamber exit 6.

In the embodiment of the honeycomb formed structure drying method, no particular limitation is imposed on the atmosphere in drying chamber 21 which is controlled to a predetermined humidity and temperature, and a humidity level of 30 to 65% and a temperature of 75 to 130° C. are preferred. The atmosphere in the drying chamber 21 is heated by the mediation of honeycomb formed structures serving as heat sources, since the honeycomb formed structures have been heated through high-frequency heating. Alternatively, the atmosphere may be controlled through feeding water vapor or hot air into the chamber or discharging the inside gas. Thus, when honeycomb formed structures have been heated in the drying chamber 21, the atmosphere in the drying chamber 21 is maintained at 75° C. or higher. Therefore, stands 12 are heated to high temperature.

As shown in FIG. 2, electromagnetic wave generators 22 are disposed on the inner surface of the ceiling 26 of the drying chamber 1 along the center axis of the outer frame 24. The electromagnetic wave generators 22 are distributed in ten zones located with virtually the same intervals. The electromagnetic wave generators 22 may be disposed in one line on the inner surface of the ceiling 26. Alternatively, in order to apply electromagnetic waves to a honeycomb formed structure to be dried as uniformly from the top end and the outer peripheral surface (side surface) as possible, for example, preferably, two lines of electromagnetic wave generators are disposed on the ceiling 26 and one line of electromagnetic wave generators on each side surface (not illustrated) of the drying chamber 1; i.e., total four lines of electromagnetic wave generators 22 are disposed (40 electromagnetic wave generators 22 in total). The electromagnetic wave generators 22 may be provided five or more lines. The number of the electromagnetic wave generators 22 disposed in one line is not limited to ten, and may be appropriately determined in accordance with factors such as the length of the drying chamber 1. In addition, the outer frame 24 is preferably surrounded by a heat insulating material.

The electromagnetic wave generator 22 may be a magnetron, a dielectric electrode, etc. In the embodiment of the honeycomb formed structure drying method, the electromagnetic wave employed in high-frequency drying preferably has a frequency of 10 to 10,000 MHz, more preferably 915 to 10,000 MHz. When the frequency is lower than 10 MHz, water is difficult to undergo high-frequency heating, and honeycomb formed structures may be difficult to dry. In contrast, when the frequency is higher than 915 MHz, water undergoes high-frequency heating more effectively. As shown in FIG. 2, the electromagnetic wave generators 22 may be disposed inside the drying chamber 21. Alternatively, electromagnetic wave generators 22 may be disposed outside the drying chamber 21, and the generated electromagnetic wave is guided through a predetermined site of the drying chamber 21 into the drying chamber 21 via a waveguide so as to apply the electromagnetic wave to the honeycomb formed structures.

The energy of the electromagnetic wave applied to the honeycomb formed structures is appropriately determined in accordance with factors such as the capacity of the drying chamber 1, and the number and dimensions of honeycomb formed structures accommodated in the drying chamber 1. For example, when the capacity of the drying chamber 21 is about 7 $m^3$, the total energy is preferably 150 to 300 kW. When the energy is smaller than 150 kW, the honeycomb formed structures may fail to be dried to a predetermined drying degree, whereas when the energy is higher than 300 kW, the vaporization speed of water from the honeycomb formed structures is elevated, and difficulty may be encountered in reduction of the difference in drying condition between the inner part of the honeycomb formed structure and the outer part thereof.

Preferably, the undried honeycomb formed structures 10 are transferred into the drying chamber 1 and dried through high-frequency heating such that 50 to 99 mass % of water contained in each undried formed structure 10 is evaporated at the end of high-frequency heating.

As shown in FIG. 2, the hot air drying chamber 31 is provided in the drying apparatus 1 in the vicinity of the drying apparatus exit 6 of the drying apparatus 1. Dried honeycomb formed structures 11 are transferred into the hot air drying chamber by means of a conveyer, and the hot air fed by means of a hot air generator 32 disposed under the hot air drying chamber 31 is applied to the dried honeycomb formed structures 11 in the direction from the bottom to the top end. The hot air fed by means of the hot air generator 32 into the hot air drying chamber 31 is discharged to the outside through a hot air discharge duct 33 disposed above the hot air drying chamber 31 (space between the ceiling 26 and the roof 25). The aforementioned hot air preferably has a temperature of 100 to 130° C. When the temperature is lower than 100° C., the dried honeycomb formed structures may be difficult to dry, whereas when the temperature is higher than 130° C., a binder may be vaporized or burnt.

No particular limitation is imposed on the type of the hot air generator 32 so long as the generator attains predetermined temperature and flow rate. For example, a hot air generator having a heater employing high-temperature water vapor or an electric heater and a blower may be used. In the generator, a blow generated by the blower is heated to provide hot air. The hot air generated by the hot air generator 32 may be used.

The hot air drying chamber 31 is provided in the form of a chamber having a predetermined area in the drying apparatus 1 so as to be aligned with the longitudinal direction of the drying chamber 21. Needless to say, the hot air drying chamber 31 may be provided outside the drying apparatus 1.

As shown in FIG. 1, the conveyer 2 employed in the embodiment of the honeycomb formed structure drying method may have a continuously linked structure, whereby honeycomb formed structures are circulated. Alternatively, individual conveyers may be employed in the steps (e.g., drying apparatus 1 and cooling apparatus 3), and honeycomb formed structures may be circulated by means of these conveyers in combination. The conveyer 2 may be a roller conveyer, a belt conveyer, a chain conveyer, or a rack-and-pinion mechanism. The conveyer 2 is required to be made from a material which is heat-resistant and is not readily deteriorated when irradiated with a high-frequency wave, and flame-resistant resins such as aramid fiber and fluororesins (e.g., Teflon (trade name)) are preferably employed.

Figure 3:
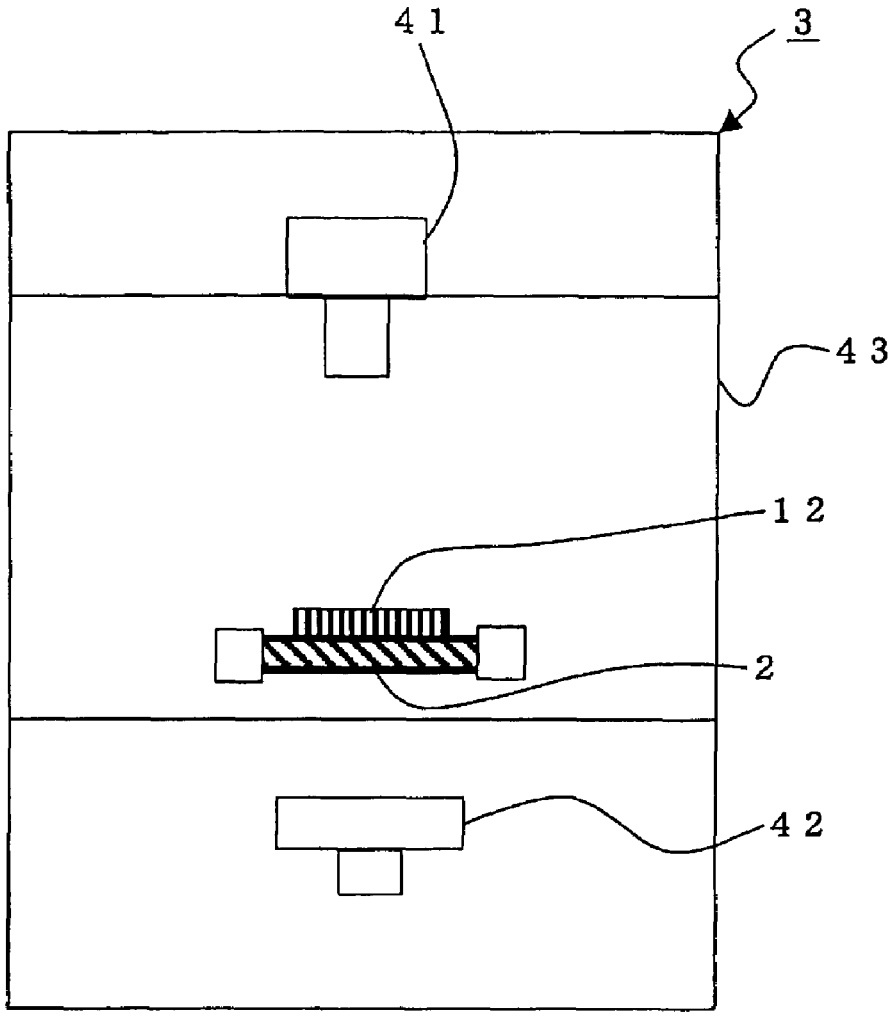
[FIG. 3] A cross-sectional view of a cooling apparatus employed in an embodiment of the honeycomb formed structure drying method of the present invention, the cross-section being taken along a plane normal to the center axis (stand running direction).

As shown in FIG. 3, the cooling apparatus 3 employed in the embodiment of the honeycomb formed structure drying method is formed of a cylinder-shape cooling apparatus outer frame 43 where the conveyer 2 runs; a cold air generator 41 disposed above the conveyer 2; and a discharge duct 42 disposed under the conveyer 2. FIG. 3 is a cross-sectional view of a cooling apparatus 3 employed in the embodiment of the honeycomb formed structure drying method of the present invention, the cross-section being taken along a plane normal to the center axis (stand 12 running direction). The cold air generator 41 is provided with a blower (not illustrated), which allows cold air to apply to the stand 12 placed on the conveyer 2. The cold air preferably has a temperature of 30° C. or lower, more preferably 25° C. or lower. When the temperature is higher than 30° C., the stand 12 cannot be cooled to 30° C. or lower. Therefore, when an undried honeycomb formed structure is placed on the stand 12, the undried honeycomb formed structure may be gelled. The gas contained in the cooling apparatus 3 is discharged through a discharge duct 42. The discharge duct 42 may be provided with a forced discharge apparatus (not illustrate), by which the gas contained in the cooling apparatus 3 is forcedly discharged.

In the case in which stands each having dimensions of 350 mm×350 mm and a mass of 2.5 kg are heated in a drying apparatus, and the stands which have been heated to 85° C. in the drying apparatus are cooled through application thereto of cold air (20° C., velocity: 5 m/s, and flow rate: 30 $m^3$/min), the stands can be cooled to 30° C. within 15 seconds. The stands may be allowed to cool in an atmosphere at 30° C. or lower. However, when the stands of the aforementioned shape and mass are allowed to cool at 25° C., cooling to 30° C. requires about 20 minutes. Therefore, in order to realize continuous production of honeycomb formed structures, a large number of stands and a long conveyer length are required. Thus, a cooling apparatus is preferably employed in the case where the time of cooling the stands must be shortened. In the present embodiment, when a cooling apparatus is employed under the aforementioned conditions, the number of stands can be reduced by 60%, and the length of the conveyer (apparatus length) can be shortened by about 10 m, as compared with natural cooling.

When the cold air generator 41 is provided merely with a blower, preferably, water of 30° C. or lower is sprayed onto the stands 12 before application of air to the stands 12 by means of the blower, followed by applying air by means of the blower. When the stands 12 are wetted by spraying water onto the stands 12, water vaporizes during application of air to the stands 12, heat corresponding to heat of vaporization of water is deprived from the stands 12. This cooling effect is equivalent or superior to the case where cold air of 30° C. or lower is applied. When water is sprayed onto the stands 12, preferably, water is removed through air fed by the blower so as to prevent retention of water in the stands 12. This operation is performed in order to prevent deformation of undried honeycomb formed structures 10 caused by water. Instead of water, highly volatile liquid such as alcohol may be sprayed thereonto. When the outer air temperature is lower than 30° C., outer air may serve as the cold air after filtration. Alternatively, the cold air generator 41 is provided with a blower and a cooling apparatus, and air cooled to 30° C. or lower by means of the cooling apparatus may be applied to the stands 12 by means of the blower. When the cooling apparatus is provided, a blower is not necessarily provided. In this case, the cooling apparatus 3 may be filled with the air cooled by means of the cooling apparatus by way of convention.

The shape of the cooling apparatus 3 is not limited to the configuration having the cylinder-form cooling apparatus outer frame 43 as shown in FIG. 3. For example, only a cold air generator 41 may be provided above the conveyer 2 (stands 12) or on a side surface thereof, whereby cold air is applied to the stands 12. In this case, the technique of spraying water onto the stands 12 and the way of provision of the cooling apparatus are preferably employed, similar to the aforementioned case.

Preferably, each of the stands 12 shown in FIG. 2 has a plurality of through-holes running in a direction virtually normal to a face that defines an area which, when the honeycomb formed structure is placed on the stand, abuts the bottom surface of the honeycomb formed structure (hereinafter the face is referred to as the receiving face), and the through-holes are formed so as to have a percent opening with respect to the receiving face of 50% or more, more preferably 70% or more. As used herein, the term "percent opening with respect to the receiving face" refers to the value calculated by dividing the total surface area of the through-holes cut along the receiving surface by the entire surface area the receiving face and multiplying by 100.

When the percent opening is less than 50%, passage of gas through the stands 12 is impeded. In this case, when honeycomb formed structures are placed on the stands 12, passage of water vapor or air through a face of each stand 12 which a honeycomb formed structure abuts (i.e., receiving face) is impeded, possibly resulting in difficulty in drying of the honeycomb formed structure. Particularly when hot air is applied to the dried honeycomb formed structure 11 in the hot air drying chamber 31 upwardly in the direction from the top surface of the stand 12, pressure loss in the stand 12 increases, and the velocity of hot air flow which is applied to the dried honeycomb formed structure 11 decreases, possibly resulting in difficulty in drying of the honeycomb formed structure. In contrast, when the percent opening is 70% or more, drop in hot air flow velocity can be virtually prevented.

The stands are preferably formed of at least one species selected from among MgO, $Al_2O_3$, and $SiO_2$, which form cordierite ($2MgO.2Al_2O_3.5SiO_2$). Among them, alumina ($Al_2O_3$) is preferred. Using such a cordierite's raw material composition—that will produce cordierite when fired—in the manufacture of a stand provides the following advantage. In operation, when a flaw is generated in an undried honeycomb formed structure during the forming process, the undried honeycomb formed structure must be crushed to return to a bulk of honeycomb raw material composition. In such a situation, even if accidentally chipped fragments of the stand have migrated into the raw honeycomb material composition, forming failure of a honeycomb formed structure during forming of the raw material composition can be prevented.

When the stand are not formed from at least one species selected from among cordierite components but are formed from, for example, fired cordierite, and chipped fragments of the stands migrate into a new raw material composition, honeycomb formed structures obtained from the raw material composition (cordierite sources) may exhibit drop in percent water absorption and increase in thermal expansion coefficient. As used herein, the term "percent water absorption" refers to a value calculated by dividing the mass of water absorbed by a sample cut from a fired honeycomb formed structure which has been immersed in water at 30° C. by the mass of the honeycomb formed structure, and the term "thermal expansion" refers to a value calculated by the expansion amount of a sample cut of a fired honeycomb formed structure upon heating to 800° C. by the difference between the sample temperature before heating and heating temperature. Specifically, when a raw material composition contains no fired cordierite, the percent water absorption is 20 mass %. In contrast, when fired cordierite has migrated into the composition at percent migrations of fired cordierite of 0.1 mass %, 0.2 mass %, and 0.3 mass %, percent water absorption values are 15 mass %, 14 mass %, and 13 mass %, respectively. The percent migration is obtained by dividing the mass of fired cordierite having migrated by the mass of the raw material composition containing the fired cordierite, and multiplying by 100. The results indicate that percent water absorption drastically decreases with increasing amount of migrated fired cordierite. When a raw material composition contains no fired cordierite, the thermal expansion is $0.5\times10^{-6}$/° C. In contrast, when fired cordierite has migrated into the composition at percent migrations of fired cordierite of 0.1 mass %, 0.2 mass %, and 0.3 mass %, thermal expansion values are in all the cases $2.0\times10^{-6}$/° C. The results indicate that thermal expansion drastically increases through migration of fired cordierite.

Preferably, the stands are formed from an organic substance having a softening temperature higher than 130° C. When the softening temperature is 130° C. or lower, the stands may be softened and deformed in the drying apparatus, possibly failing to serve as stands. Using such an organic substance in the manufacture of a stand provides the following advantage. In the aforementioned case in which the undried honeycomb formed structure must be crushed to return to a bulk of honeycomb raw material composition, even if accidentally chipped fragments of the stand have migrated into the raw honeycomb material composition, the organic substance is burnt out during firing of dried honeycomb formed structures. Therefore, the fired honeycomb formed structures are nor adversely affected.

Figure 4:
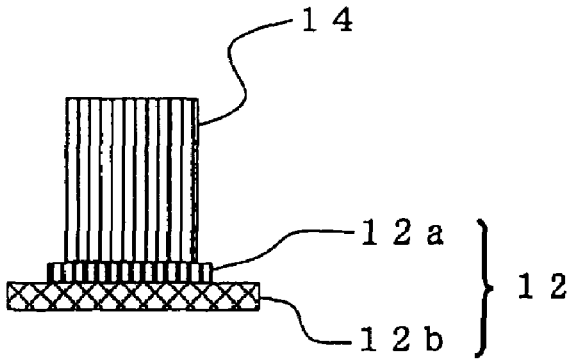
[FIG. 4] A cross-section showing a honeycomb formed structure placed on a stand.

As shown in FIG. 4, the stand 12 may have a receiving member 12*a* disposed on a support 12*b*, and a honeycomb formed structure 14 may be placed on the receiving member 12*a*. In addition, the receiving member 12*a* is preferably formed from at least one species selected from among the aforementioned cordierite components, alumina, or an organic substance having a softening temperature higher than 130° C. Through employment of the configuration and material, even when the stand 12 is partially chipped, the stand can be employed simply through substituting the chipped receiving member 12*a* with a new one. FIG. 4 is a cross-sectional view showing a honeycomb formed structure placed on a stand.

No particular limitation is imposed on the shape of stands, so long as a honeycomb formed structure can be placed on the stand in a stable manner, and the stand can be placed on the conveyer and circulated via the drying apparatus 1 and the cooling apparatus 3. For example, the plan-view shape of the stand is preferably a plate-like form such as a circle, an ellipsoid, or a polygon (e.g., triangle, square, or pentagon). The receiving member 12*a* and support 12*b* shown in FIG. 4 may be identical in plan-view shapes, respectively.

When an undried honeycomb formed structure formed in a forming step by means of a forming apparatus (e.g., extruder) is placed on a stand employed in the embodiment of the honeycomb formed structure drying method, an undried honeycomb formed structure discharged from the forming apparatus may be placed directly on the stand. Alternatively, an undried honeycomb formed structure discharged from the forming apparatus may be placed on another placement stand, followed by transferring to the stand.

The embodiment of the honeycomb formed structure drying method is suitable for drying a honeycomb formed structure made of ceramic material, having a percent opening of 80% or more and a partition wall thickness of 0.18 mm or less. As used herein, the term "percent opening" refers to a ratio (percent) of the total cross-sectional area of the cell through-holes to the cross-sectional area of the honeycomb formed structure in which the cell through-holes are located, as viewed in a cross-section of a honeycomb formed structure cut in a direction normal to the center axis. Examples of the material for forming the honeycomb formed structures (material after firing) include cordierite, alumina, and SiC. Examples of the binder contained in the raw material composition for forming a honeycomb formed structure include at least one water-soluble compound selected from the group consisting of methyl cellulose binders, poly(vinyl alcohol), and hydroxyethyl cellulose binders.

INDUSTRIAL APPLICABILITY

In the production of a honeycomb formed structure, particularly a ceramic honeycomb formed structure, through provision of a honeycomb formed structure drying method which prevents, during a honeycomb formed structure drying step included in the production thereof, deformation such as warpage of partition walls of the honeycomb formed structure is prevented, whereby high-quality, deformation-free honeycomb formed structures can be produced.

The invention claimed is:

1. A method for drying a honeycomb formed structure, the method comprising placing on a plurality of stands a plurality of honeycomb formed structures in an undried state (undried honeycomb formed structures) which have been formed into a honeycomb structure a raw material composition containing a ceramic material, a binder, and water;

causing the undried honeycomb formed structures placed on the stands to pass through a drying apparatus equipped with a high-frequency heating means for providing a heated atmosphere from an entrance of the apparatus to an exit thereof;

drying the undried honeycomb formed structures through high-frequency heating, to thereby form dried honeycomb formed structures;

removing, from the stands, the dried honeycomb formed structures which have passed through the exit of the drying apparatus;

conveying the stands transferred through the exit of the drying apparatus to enter the entrance thereof in a circulating manner;

placing newly formed undried honeycomb formed structures on the stands which have been circulated and returned to enter the entrance of the drying apparatus; and repeating these operations, wherein the stands which have been heated in the drying apparatus are cooled to a temperature lower than the gelation temperature of the undried honeycomb formed structures until the stands are circulated and returned to enter the entrance of the drying apparatus; the newly formed undried honeycomb formed structures are placed on the cooled stands; and the undried honeycomb formed structures are caused to pass through the drying apparatus, thereby preventing partial deformation of dried honeycomb formed structure products, which deformation might be caused by localized heating, through heat from the stands, of portions of the undried honeycomb formed structures in contact with the stands and portions in the vicinity thereof (contact portions) upon placement of the undried honeycomb formed structures on the stands.

2. A method for drying a honeycomb formed structure as described in claim 1, wherein, after removal from the stands of the dried honeycomb formed structures placed on the stands, the stands are cooled to a temperature lower than the gelation temperature of the undried honeycomb formed structures by application of cold air at 30° C. or lower.

3. A method for drying a honeycomb formed structure as described in claim 1, wherein, after removal from the stands of the dried honeycomb formed structures placed thereon, the stands are cooled to a temperature lower than the gelation temperature of the undried honeycomb formed structures by spraying water at 30° C. or lower onto the stands, followed by applying cold air to the stands.

4. A method for drying a honeycomb formed structure as described in claim 1, wherein, after drying of the undried honeycomb formed structures in the drying apparatus through high-frequency heating, to thereby form dried honeycomb formed structures, the dried honeycomb formed structures are further dried through application of hot air thereto in a hot air drying chamber disposed in the drying apparatus or outside the drying apparatus; the dried honeycomb formed structures are transferred from the hot air drying chamber; and subsequently, the dried honeycomb formed structures placed on the stands are removed therefrom.

5. A method for drying a honeycomb formed structure as described in claim 1, wherein each of the stands has a plurality of through-holes running in a direction virtually normal to a face that defines an area which, when the honeycomb formed structure is placed on the stand, abuts the bottom surface of the honeycomb formed structure (hereinafter the face is referred to as the receiving face), and the through-holes are formed so as to have a percent opening with respect to the receiving face of 50% or more.

6. A method for drying a honeycomb formed structure as described in claim 1, wherein the stands are made of at least one species selected from the components forming cordierite.

7. A method for drying a honeycomb formed structure as described in claim 6, wherein the stands are made of alumina.

8. A method for drying a honeycomb formed structure as described in claim 1, wherein the stands are made of an organic material having a softening temperature higher than 130° C.

9. A method for drying a honeycomb formed structure as described in claim 1, wherein the electromagnetic wave employed in the high-frequency heating has a frequency of 10 to 10,000 MHz.

* * * * *